US006529133B2

(12) United States Patent
Tamaoki et al.

(10) Patent No.: US 6,529,133 B2
(45) Date of Patent: Mar. 4, 2003

(54) REPOSITORY AND MONITORING SYSTEM THEREFOR

(75) Inventors: Yuichi Tamaoki, Oizumi-machi (JP); Tetsuya Miyoshi, Tatebayashi (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 0 days.

(21) Appl. No.: 09/819,835

(22) Filed: Mar. 28, 2001

(65) Prior Publication Data

US 2001/0026224 A1 Oct. 4, 2001

(30) Foreign Application Priority Data

Mar. 31, 2000 (JP) ..... 2000-098378

(51) Int. Cl.[7] ..... G08B 17/00

(52) U.S. Cl. ..... 340/584; 340/585; 340/587; 340/539; 340/870.07; 340/870.08; 340/870.09; 340/876.19; 62/229; 62/79; 62/175; 62/335

(58) Field of Search ..... 340/584, 585, 340/587, 539, 870.07, 870.08, 870.09, 870.17, 870.16; 62/229, 79, 175, 335

(56) References Cited

U.S. PATENT DOCUMENTS

| | | | | |
|---|---|---|---|---|
| 3,491,544 A | | 1/1970 | Webber | 62/77 |
| 3,848,231 A | | 11/1974 | Wootton | 340/164 |
| 4,278,841 A | * | 7/1981 | Regennitter et al. | 179/5 R |
| 4,482,785 A | * | 11/1984 | Finnegan et al. | 179/5 P |
| 4,855,721 A | * | 8/1989 | Hallett et al. | 340/585 |
| 4,885,564 A | * | 12/1989 | Vercellotti et al. | 340/310 A |
| 5,038,575 A | * | 8/1991 | Yamada | 62/234 |
| 5,351,499 A | * | 10/1994 | Takemasa | 62/114 |
| 5,424,720 A | | 6/1995 | Kirkpatrick | 340/585 |
| 5,460,006 A | * | 10/1995 | Torimitsu | 62/127 |
| 5,499,512 A | * | 3/1996 | Jurewicz et al. | 62/229 |
| 5,687,579 A | * | 11/1997 | Vaynberg | 62/175 |
| 6,161,391 A | * | 12/2000 | Trieskey | 62/79 |
| 6,215,405 B1 | * | 4/2001 | Handley et al. | 340/584 |
| 6,218,946 B1 | * | 4/2001 | Chao Jung | 340/573.1 |

FOREIGN PATENT DOCUMENTS

| | | | |
|---|---|---|---|
| EP | 0 453 302 A1 | 4/1990 | F25B/49/00 |
| FR | 2 574 916 | 12/1984 | F25D/29/00 |
| FR | 0 227 504 A1 | 10/1986 | F25B/49/00 |
| FR | 2 647 538 | 5/1989 | F25B/49/00 |
| JP | HEI-6-88666 | 3/1994 | F25D/16/00 |
| JP | 10276478 | 10/1998 | H04Q/9/00 |

* cited by examiner

*Primary Examiner*—Daniel J. Wu
*Assistant Examiner*—Tai T. Nguyen
(74) *Attorney, Agent, or Firm*—Darby & Darby

(57) ABSTRACT

A repository including: an input unit (3) for setting the temperature of the interior (2) of a repository (1); a measuring unit (5,6) for measuring the temperature of the interior of the repository (1); a controller (4) for holding ID data to specify the repository itself and communicatively outputting the measurement data to the external; and an auxiliary power source (13) for communicating the measurement data to the external even during interruption of power supply. A central controller 11 for collecting the measured data from each repository and judging whether abnormality occurs or not is connected to plural repositories to fabricate a monitoring system. When abnormality is detected, the measured data as well as ID data and time data are transmitted to a user through the Internet.

14 Claims, 4 Drawing Sheets

REPOSITORY AND MONITORING SYSTEM THEREFOR

BACKGROUND OF THE INVENTION

1. Field of the Invention

The present invention relates to a technique for use in a remote monitoring system for monitoring repositories such as a freezer, an ultra-low-temperature freezer, a refrigerator, a cold reserving repository, etc., and particularly to a repository for which some physical quantities such as temperature, pressure, volume, etc. are controlled, a remote monitoring system suitable for monitoring the variation of a physical quantity of the repository, an information terminal for controlling the monitoring operation of the remote monitoring system.

2. Description of the Related Art

A remote monitoring system for repositories is disclosed in Japanese Laid-open patent Application No. Hei-6-88666. According to this monitoring system, an auxiliary cooling operation is carried out when there occurs such an abnormal condition that the temperature of the interior of a freezer is varied due to failure of a compressor installed in the freezer or interruption (failure) of electric power supply thereto, and also an alarm for notifying occurrence of the abnormal condition is automatically issued. The monitoring system disclosed in the above publication includes a temperature sensor for detecting the temperature in the freezer, an auxiliary cooling device using liquid carbonic acid gas, etc. for carrying out the auxiliary cooling operation of the interior of the freezer in response to an alarm output from the temperature sensor, an automatic telephone signal emitting terminal for automatically sending an alarm (artificial voice) to a supervisory specialist agent (or user) through a public telephone line in response to the alarm output from the temperature sensor, and a system of a user company which is the owner of the freezer and receives the alarm from the automatic telephone signal emitting terminal.

According to the conventional monitoring system described above, an alarm is generated and output with an artificial voice to a user company or the like through a public telephone line by the automatic telephone signal emitting terminal when some abnormality occurs in the freezer. Therefore, the user can merely know occurrence of some abnormality in his/her freezer, however, he/she cannot know the content of the abnormality itself because the alarm is merely output with an artificial voice.

Besides, there is also known a technique of notifying occurrence of an abnormality through E-mail although this technique does not direct to monitor the temperature of a freezer. According to this technique, since only occurrence of an abnormality is merely transmitted through E-mail, the user can merely known occurrence of some abnormality, and thus he/she cannot know the detailed information on the abnormality because the alarm is merely output with a predetermined alarm message.

SUMMARY OF THE INVENTION

Therefore, the present invention has been implemented in view of the foregoing situation, and has an object to provide a repository which can be easily monitored when it is under surveillance.

Another object of the present invention is to provide a repository from which measurement data can be automatically output to a user when some abnormality occurs even under the state that power supply fails.

Further object of the present invention is to provide a repository for which internal temperature records and trouble forecasts can be easily implemented and client supports can be also easily performed.

Further object of the present invention is to provide a monitoring system for monitoring abnormality of the repository.

In order to attain the above objects, according to a first aspect of the present invention, there is provided a repository for keeping things under a predetermined fixed environmental condition, including: an input unit for inputting a target internal temperature of the main body of the repository; a measuring unit for measuring the internal temperature of the main body of the repository; a controller for communicatively outputting the measurement data obtained by the measuring unit to the external; and an unit for enabling the controller to output the measurement data to the external even during interruption of power supply.

The above repository may include a two-stage refrigeration system comprising two refrigeration circuits which are cascade-connected to each other and perform heat exchange, and a temperature measuring unit for measuring the temperature of a thermally-coupled portion of said two refrigerant circuits.

In the repository, the thermally-coupled portion is a cascade-condenser of the two-stage refrigeration system.

In the repository, the controller may hold ID data to specify the repository itself.

In the repository, the unit may be an auxiliary power source for applying power to the controller to output the measurement data to the external even during the interruption of power supply.

The repository may further include a refrigeration circuit having an evaporator equipped with a defrost sensor, and another measuring unit for measuring the temperature of the defrost sensor, wherein the measured data of the temperature of the defrost sensor are also output to the external.

According to a second aspect of the present invention, there is provided a monitoring system for at least one repository for keeping things under a predetermined fixed environmental condition, characterized by comprising: an input unit for inputting a target internal temperature of the main body of the repository; a measuring unit for measuring the internal temperature of the main body of the repository; a controller for receiving the measurement data from the measuring unit and communicatively outputting the measurement data; a central controller for receiving the measurement data from the controller and comparing the measured internal temperature with the target internal temperature and outputting the measurement data obtained by said measuring unit to the external if the difference between the measured internal temperature and the target internal temperature is larger by a threshold value.

In the monitoring system, the central controller adds time data to the measured data and distributes the measured data added with the time data together with ID data representing the repository concerned through the Internet to prescribed Internet addresses.

The repository further includes an auxiliary power source for enabling the data communication between the controller and the central controller even during interruption of power supply.

In the repository, the data communication between the controller and the central controller is carried out by using a predetermined communication protocol.

According to a third aspect of the present invention, there is provided a monitoring system for a plurality of repositories for keeping things under a predetermined fixed environmental condition, characterized by comprising: an input unit which is equipped to each repository to input a target physical quantity affecting the environmental condition of each repository; a measuring unit which is equipped to each repository to measure the physical quantity affecting the environmental condition of the repository; a controller which is equipped to each repository to hold ID data specifying the repository itself and output the measurement data of the physical quantity obtained by the measuring unit to the external; a central controller for collectively receiving the measured data and the ID data from the controller of each repository, judging on the basis of the measured data whether some abnormality occurs in the physical quantity, and outputting the measured data and the ID data while adding the measured data with time data representing the measurement time if it is judged that some abnormality occurs in the physical quantity; and a distribution unit for distributing the data output from the central controller to desired Internet addresses through the Internet if it is judged that some abnormality occurs in the physical quantity.

In the monitoring system, the physical quantity is the temperature of the interior of each repository.

The monitoring system may further include an auxiliary power source which is equipped to each repository to enable the data communication between the controller and the central controller even during interruption of power supply.

DETAILED DESCRIPTION OF THE PREFERRED EMBODIMENTS

Preferred embodiments of the present invention will be described hereunder with reference to the accompanying drawings. In the following description, the term of "repository" is used to have a broader meaning. For example, it covers a space which can be closed to keep something therein, such as a case, a container, storage, a storage shed, a storage chamber, a stockroom, a storage warehouse, etc. Particularly, if the temperature control is required to the repository, the repository may be a cold reserving repository such as a freezer, a refrigerator or the like, a hot reserving repository or the like.

Figure 1:
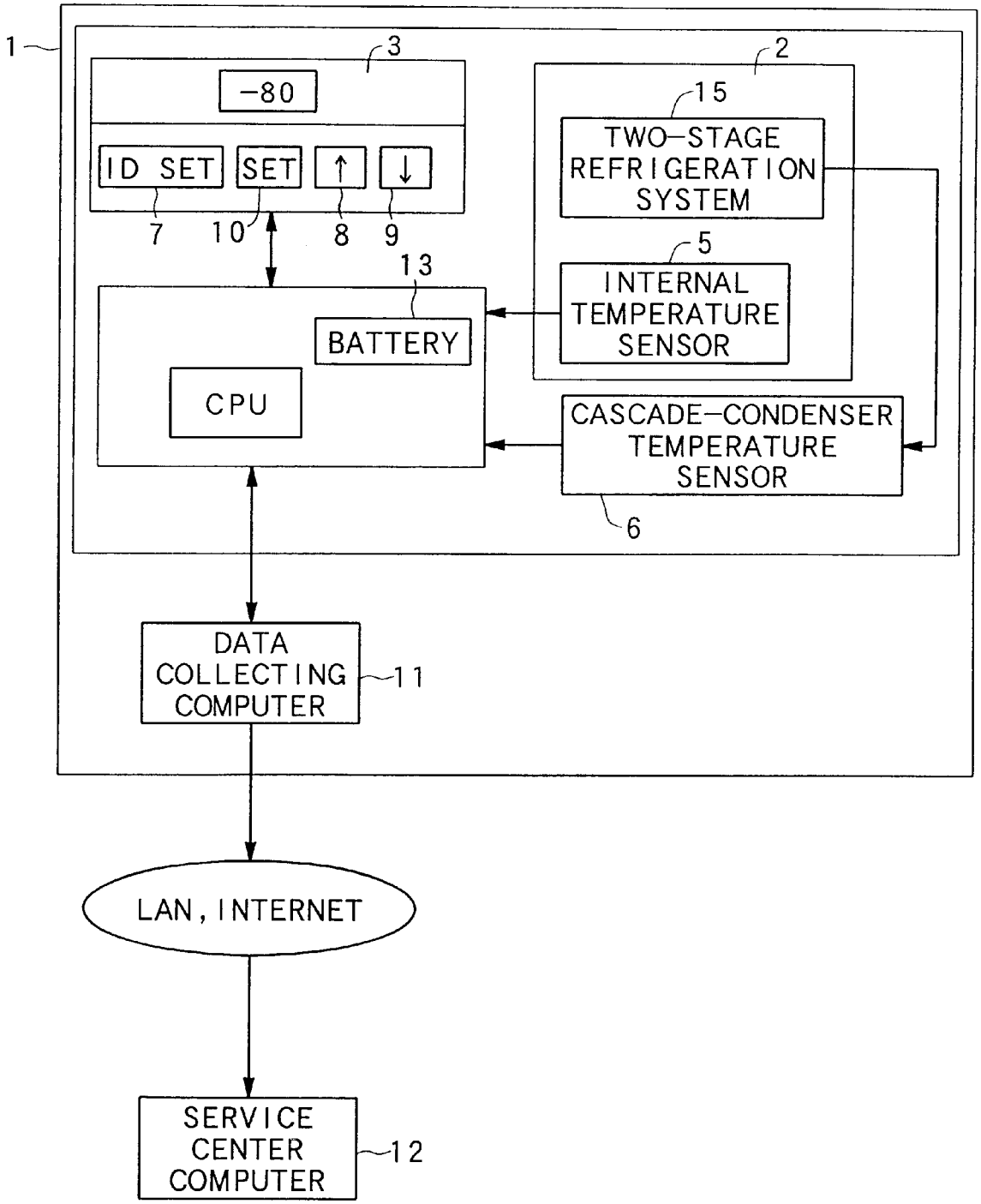
FIG. 1 is a block diagram showing a repository according to an embodiment of the present invention.
Figure 2:
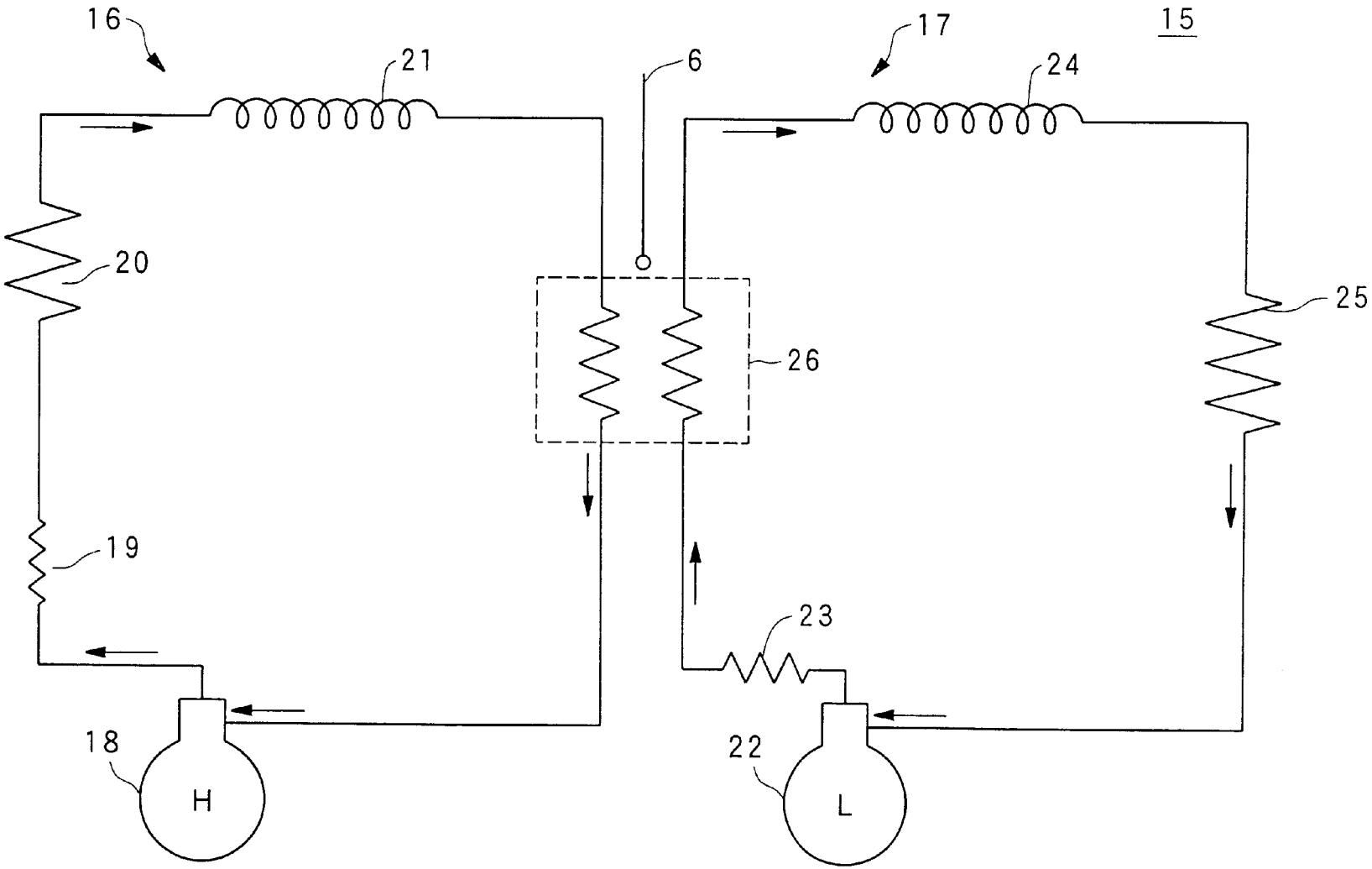
FIG. 2 is a schematic diagram showing a two-stage refrigeration system (cascade refrigeration system)

FIG. 1 shows a monitoring system containing a repository according to an embodiment of the present invention, and FIG. 2 is a schematic diagram of a two-stage refrigeration system (circuit) used to cooling/heating the interior of the repository.

In FIG. 1, reference numeral 1 represents a cold reserving (refrigerating) repository (for example, an ultra-low-temperature freezer), reference numeral 2 represents the main body of the repository 1, and reference numeral 3 represents an operating unit for displaying the temperature of the interior of the main body 2 of the freezer 1 and setting/inputting a desired (target) temperature. Reference numeral 4 represents a control board unit which is equipped with CPU and controls the overall operation of the freezer 1, and reference numeral 5 represents an in-freezer temperature measuring sensor for detecting the temperature of the interior of the main body 2 of the freezer 1.

In this embodiment, the repository 1 includes a two-stage refrigeration system (cascade refrigeration system) 15 containing two cascade-connected refrigeration circuits (high temp. side refrigeration circuit 16 and low temp. side refrigeration circuit 17), and each refrigeration circuit has a heat exchange portion (condenser, evaporator, cascade-condenser) for performing heat exchange as shown in FIG. 2. The high temp. side refrigeration circuit 16 includes a high temp. side compressor 18, a pre-condenser 19, a condenser 20, a capillary tube 21 and an evaporator serving as a part of a cascade condenser 26. The low temp. side refrigeration circuit 17 includes a low temp. side compressor 22, a pre-cooler 23, a condenser serving as a part of the cascade-condenser 26, a capillary tube 24 and an evaporator 25.

Reference numeral 6 represents a temperature sensor for measuring the temperature in the neighborhood of a thermally-coupling portion of the high and low temp. side refrigeration circuits 16 and 17, for example, in the neighborhood of the cascade-condenser 26 of the two-stage refrigeration system 15.

Reference numeral 7 represents a setting start button of setting ID data of the freezer 1, and reference numerals 8 and 9 represent up and down buttons for increasing/decreasing the target temperature respectively. The ID data value, the target temperature, etc. are set by using these buttons. Reference numeral 10 represents a temperature setting operation start button, and reference numeral 11 represents an information terminal such as a portable (note type) computer in which a battery for data collection or the like is installed.

In FIG. 1, the freezer 1 and the information terminal 11 are connected to each other in one-to-one correspondence, however, a plurality of cold reserving repositories (freezers) 1 are actually connected to the single information terminal 11. These plural freezers can be discriminated from one another on the basis of the ID data allocated to the respective freezers. The connection between the information terminal 11 and each freezer (control board 4) may be connected to each other through a cable or wirelessly.

Reference numeral 12 represents a computer of a service center which monitors the condition of each freezer. The service center computer 12 and the data collection computer 11 are connected to each other through LAN, the Internet or the like to communicate data with each other.

Reference numeral 13 represents a battery (auxiliary power source). For example, when power supply to the freezer 1 fails due to some accident, the interruption of power supply is notified with a buzzer (not shown) or lamp (not shown) by the battery, and also the data communication between the information terminal 11 and the control board unit 4 is enabled by the battery 13.

As described above, the information terminal 11 may be also connected to other freezers (not shown), and it communicates with the control board unit of each freezer to collect the ID data, the target (set) internal temperature, the measured internal temperature, the temperature in the neighborhood of the heat exchange portion, etc. from each freezer (repository). The information terminal 11 adds a data collection time to the collected data every freezer, and records them as a data file. The data of each data file are automatically transmitted to a destination having a predetermined Internet address (E-mail address).

In this embodiment, not only the measurement data on the internal temperature of the repository, but also the measurement data on the temperature in the neighborhood of the heat exchange portion (for example, the cascade-condenser) of the two-stage refrigeration system are transmitted to the control board 4, and further transmitted to the data collecting computer 11. The measurement data on the temperature in the neighborhood of the heat exchange portion is also transmitted to more clearly estimate a cause of abnormality.

For example, if an abnormal variation occurs in the internal temperature of the repository, the measured data of the internal temperature thus abnormally varying are transmitted to a user through E-mail. The user can know the abnormal variation of the internal temperature of the repository and also the measurement data on the temperature variation. However, the user has not yet been able to estimate a cause by which the internal temperature is abnormally varied. When the measurement data on the temperature in the neighborhood of the heat exchange portion (or the measurement data on other thermally coupled portions) are transmitted together with the measurement data on the internal temperature of the repository, the user also checks the measurement data on these measurement data of the thermally coupled portions.

If these measurement data are normal values, the user can recognize that abnormality occurs in other places than the two-stage refrigeration system, and thus the user can use these data for elimination by comparison to specify the cause of the abnormality. On the other hand, if these measurement data are abnormal values, the user can recognize that abnormality occurs in the two-stage refrigeration system. Accordingly, the user can estimate that the abnormality in the internal temperature of the repository may occur due to failure of a compressor, leakage of refrigerant or a power failure, that is, the user can use these measurement data to specify the cause of the abnormality.

As described above, if various measurement data on the physical quantities (temperature, pressure, volume, etc.) of the parts of the repository as well as the internal temperature of the repository are transmitted through E-mail, the user can more easily and surely estimate whether the currently occurring abnormality needs an urgent countermeasure or not, and thus the user can take a countermeasure more surely.

The transmission of the measurement data on the temperature of the thermally-coupled portion (the physical quantities of the parts of the repository) as well as the internal temperature of the repository may be set by user's choice on a transmission data item. However, it is preferable to set the transmission data item so that these measurement data are transmitted together with the measurement data on the internal temperature of the repository through the Internet.

Further, in a refrigeration circuit, a defrost sensor is provided to an evaporator to prevent occurrence of frost in the evaporator. In any case where the present invention is applied to a two-stage refrigeration system or a refrigeration circuit, another measuring unit for detecting the temperature of the defrost sensor may be provided and also transmitted to the user through the Internet together with the measurement data of the internal temperature to specify the cause of the abnormality.

Figure 3:
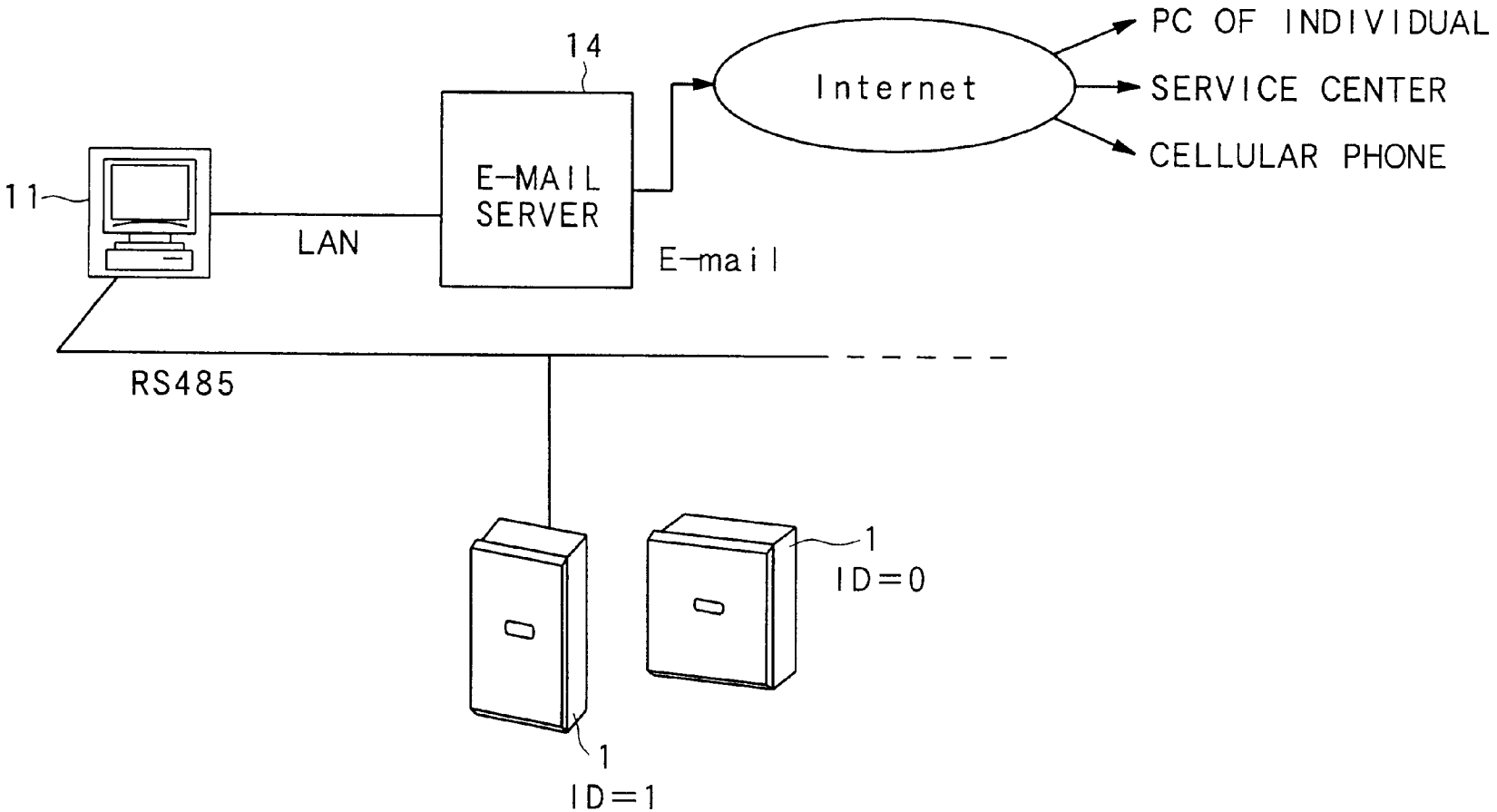
FIG. 3 is a diagram showing the connection of a monitoring system for the repository according to the present invention.
Figure 4:
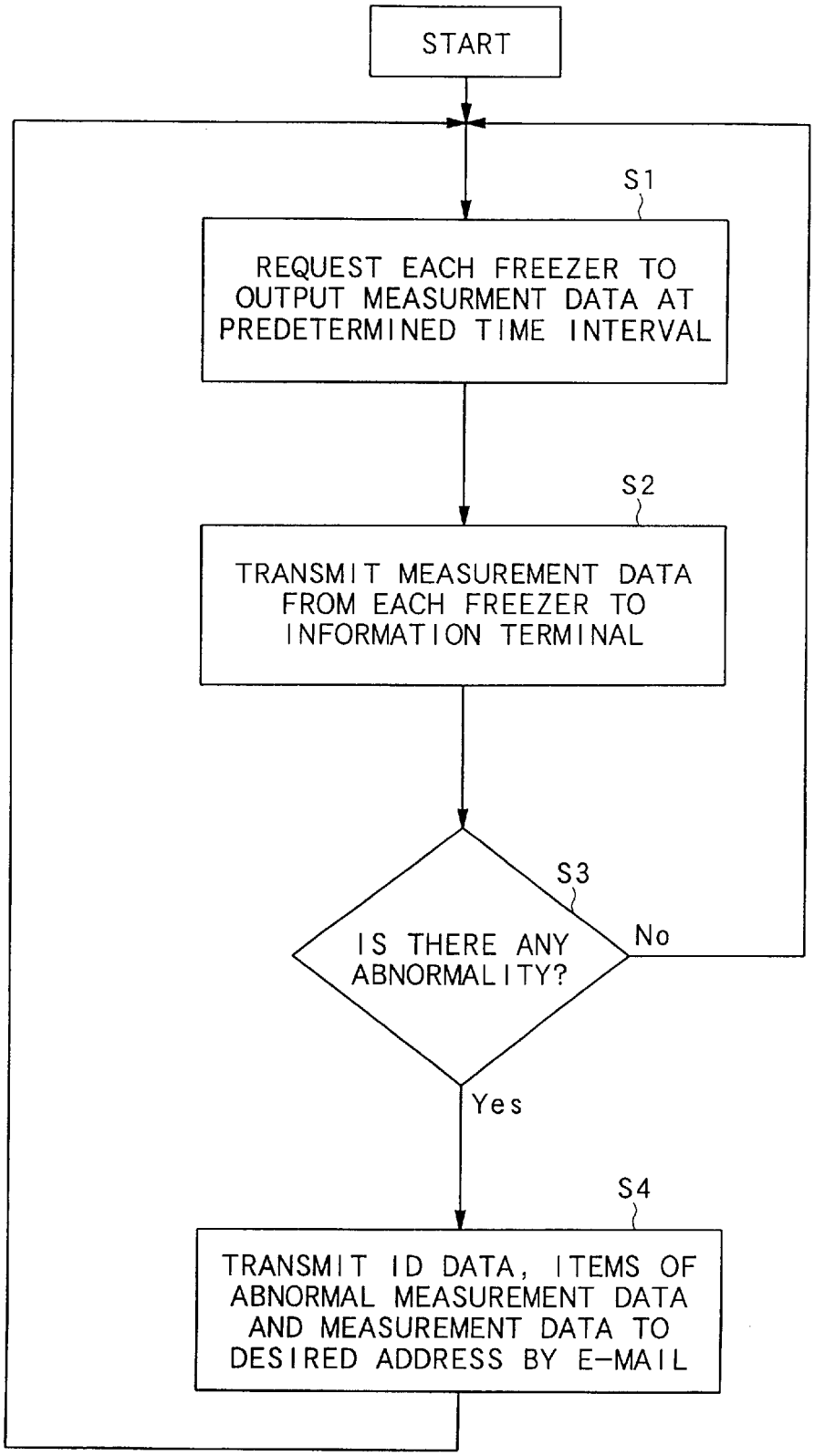
FIG. 4 is a flowchart showing the monitoring operation of the monitoring system.

FIG. 3 shows the connection arrangement of the respective units of the monitoring system according to the present invention, and FIG. 4 is a flowchart showing the monitoring operation of the monitoring system.

In the monitoring system shown in FIG. 3, two ultra-low-temperature freezers 1 are assumed to be connected to the information terminal 11 through RS485. An ID "0" is allocated to one freezer 1 while an ID "1" is allocated to the other freezer 1.

According to the monitoring operation of the monitoring system, the freezer is powered on (or the monitoring operation is started), the information terminal 11 first requests each of the freezers 1 to output measurement data such as the internal temperature, etc. at a predetermined time interval (S1). In response to the request from the information terminal 11, each freezer transmits the measurement data such as the internal temperature, etc. as well as the ID data thereof through RS485 to the information terminal 11 (S2).

The information terminal 11 judges on the basis of the measurement data transmitted from each freezer 1 whether some abnormality occurs (S3). If the information terminal 11 judges that some abnormality occurs (S3:Yes), the ID data of the freezer under abnormality, item names of abnormal measurement data, the values of the abnormal measurement data, etc. are transmitted through LAN to an E-mail server 14, and then transmitted through the Internet to a predetermined E-mail address (indicating a specific user) (S4). For example, the judgment on the abnormality may be carried out by comparing the measured data value with the set target value which is input by the operating unit 3 in advance and judging occurrence of abnormality if the difference between the measured data value and the target value is larger by a threshold value or more. If the information terminal 11 judges that no abnormality occurs, the processing goes to step S1. After the information terminal 11 transmits the abnormal measurement data, etc. to the user, its processing returns to the step S1. The destination of the E-main address may be a cellular phone, a personal computer of an individual, a service center or the like. Here, the information terminal 11 and the E-mail server 13 may be operated for a predetermined time by UPS (Uninterruptive Power Supply) (not shown) under interruption of power supply.

In the above embodiments, only when some abnormality occurs, the measurement data, etc. are output to the user, etc. However, the measurement data, etc. may be output to the user, etc. at all times even under normal operation. That is, the destination to which the E-main is transmitted may be added or changed between the normal operation and the abnormal operation. Further, the title of an E-mail may be set as "abnormal/alarm" under abnormal operation (when some abnormality occurs) while it is set as "normal/periodical communication" under normal operation.

In the above embodiments, abnormality of the internal temperature of a repository (freezer, storage or the like) is detected, and the measurement data of the repository are output to the user. However, the physical quantity in which abnormality is detected is not limited to the internal temperature of the repository. For example, the temperature of a defrost sensor of a cooler of a cooling circuit equipped to a freezer or the temperature of other parts may be measured and output to the external. Further, physical quantities other than the temperature, such as the number of revolution of a compressor, the voltage of a power supply source, etc. which are relating to the monitoring operation of a repository may be targeted as quantities to which abnormality is detected. In this case, it is needless to say that when some abnormality is detected in these quantities, the measurement data on these quantities are automatically transmitted to the user through the Internet or the like.

Further, in the above embodiments, an object for which a physical quantity such as temperature or the like is detected is a repository. However, the object of the present invention is not limited to the repository, and the present invention may be applied to other objects for which control of some physical quantity such as temperature, pressure, volume, voltage, intensity or the like is needed.

In the above embodiments, it is needless to say that an alarm device for making an alarm with light (alarm lamp) or with sound (buzzer) may be provided to each repository. In this case, the control board 4 of each repository may compare the measured internal temperature with a threshold temperature and controls the alarm lamp or the buzzer to emit light or sound if the measured internal temperature exceeds the threshold value.

The data communication between the information terminal 11 and the plural repositories under monitoring may be automatically carried out on the basis of a well known communication protocol such as a polling communication protocol or the like.

In the above embodiments, the E-mail transmission function may be provided to each repository. However, in this case, the total cost of the monitoring system is increased. Therefore, it is preferable that the E-mail function is provided to the only the information terminal. Accordingly, the measurement data obtained in each repository are transmitted to the information terminal to be subjected to some data processing, and then the measurement data thus processed are transmitted from the information terminal to the outside.

In the above embodiments, the measurement data of each repository (control board 4) may be output to the information terminal 11 through each data wire. However, in this case, the wiring work is very difficult. Therefore, it is preferable that a controller (control board 4) is provided to each repository and the measurement data of each repository is communicatively transmitted from each controller 4 to the information terminal 11 through a cable or wirelessly (preferably, according to a predetermined communication protocol). The information terminal 11 collectively receives the measurement data from the respective controllers 4 and carries out the predetermined processing on these data. In this case, since ID data is allocated to each repository (controller), the information terminal 11 can discriminate the respective controllers from one another.

What is claimed is:

1. A repository having a main body for keeping things under a predetermined fixed environmental condition, the repository comprising:

an input unit for inputting a target internal temperature of the main body of said repository;

a measuring unit for measuring the internal temperature of the main body of said repository;

a controller for communicatively outputting the measurement data obtained by said measuring unit;

a central controller for receiving the measurement data obtained from said controller and outputting the measurement data obtained by said measuring unit to an external terminal upon the occurrence of a predetermined condition, said central controller combining ID data with said measurement data so that said output measurement data indicates in which repository said predetermined condition occurred; and a unit for enabling said central controller to output the measurement data to the external terminal even during interruption of power supply.

2. The repository as claimed in claim 1, further including a two-stage refrigeration system having two refrigeration circuits which are cascade-connected to each other and perform heat exchange, and a temperature measuring unit for measuring the temperature of a thermally-coupled portion of said two refrigeration circuits.

3. The repository as claimed in claim 2, wherein said thermally-coupled portion is a cascade-condenser of said two-stage refrigeration system.

4. The repository as claimed in claim 1, wherein said controller holds ID data to specify said repository itself.

5. The repository as claimed in claim 1, wherein said unit is an auxiliary power source for applying power to said controller permitting the measurement data to be communicated between the controller and the central controller and to be communicatively output to the external terminal even during the interruption of power supply.

6. The repository as claimed in claim 1, further including: a refrigeration circuit containing an evaporator equipped with a defrost sensor; and another measuring unit for measuring the temperature of said defrost sensor, the measured data of the temperature of said defrost sensor being also output to the external terminal.

7. The repository as claimed in claim 1, wherein the predetermined condition is a condition when a difference between the measured internal temperature and a target internal temperature is greater than a threshold value.

8. A monitoring system for at least one repository having a main body for keeping things under a predetermined fixed environmental condition, including:

an input unit for inputting a target internal temperature of the main body of the repository;

a measuring unit for measuring the internal temperature of the main body of the repository;

a controller for receiving the measurement data from said measuring unit and communicatively outputting the measurement data;

a central controller for receiving the measurement data from said controller and comparing the measured internal temperature with the target internal temperature and outputting the measurement data obtained by said measuring unit to an external terminal when the difference between the measured internal temperature and the target internal temperature is larger than a threshold value, wherein said central controller combines the time data with the measured data and distributes the combined data together with the ID data representing the repository concerned to desired remote devices.

9. The monitoring system as claimed in claim 8, wherein said central controller adds time data to the measured data and distributes the measured data added with the time data together with ID data representing the repository concerned through the Internet to prescribed Internet addresses.

10. The repository as claimed in claim 8, further including an auxiliary power source for enabling the data communication between said controller and said central controller even during interruption of power supply.

11. The repository as claimed in claim 10, whereby the data communication between said controller and said central controller is carried out by using a predetermined communication protocol.

12. A monitoring system for a plurality of repositories for keeping things under a predetermined fixed environmental condition, comprising:

an input unit which is equipped to each repository to input a target physical quantity affecting the environmental condition of each repository;

a measuring unit which is equipped to each repository to measure the physical quantity affecting the environmental condition of said repository;

a controller which is equipped to each repository to hold ID data specifying said repository itself and output the measurement data of the physical quantity obtained by said measuring unit to the external;

a central controller for collectively receiving the measured data and the ID data from said controller of each repository, judging on the basis of the measured data whether some abnormality occurs in the physical quantity, and outputting the measured data and the ID data while adding the measured data with time data representing the measurement time if it is judged that some abnormality occurs in the physical quantity; and a distribution unit for distributing the data output from said central controller to desired Internet addresses through the Internet if it is judged that some abnormality occurs in the physical quantity.

13. The monitoring system as claimed in claim 12, wherein the physical quantity is the temperature of the interior of each repository.

14. The monitoring system as claimed in claim 12, further including an auxiliary power source which is equipped to each repository to enable the data communication between said controller and said central controller even during interruption of power supply.

* * * * *